US007135079B2

(12) United States Patent
Valentinovich et al.

(10) Patent No.: US 7,135,079 B2
(45) Date of Patent: Nov. 14, 2006

(54) MAGNESIUM-BASED ALLOY AND METHOD FOR THE PRODUCTION THEREOF

(75) Inventors: Tetyukhin Vladislav Valentinovich, Karl Libknekht (RU); Agalakov Vadim Vladimirovich, Svoboda (RU); Kornaukhova Lyudmila Fedorovna, Karl Libknekht (RU); Puschkarev Sergey Yuryevich, Svoboda (RU)

(73) Assignee: Joint Stock Company "AVISMA-titanium-magnesium works" (RU)

( * ) Notice: Subject to any disclaimer, the term of this patent is extended or adjusted under 35 U.S.C. 154(b) by 345 days.

(21) Appl. No.: 10/496,024

(22) PCT Filed: Apr. 22, 2002

(86) PCT No.: PCT/RU02/00189

§ 371 (c)(1),
(2), (4) Date: May 19, 2004

(87) PCT Pub. No.: WO03/056050

PCT Pub. Date: Jul. 10, 2003

(65) Prior Publication Data

US 2005/0000605 A1 Jan. 6, 2005

(30) Foreign Application Priority Data

Dec. 26, 2001 (RU) ..... 2001135786

(51) Int. Cl.
*C22C 23/02* (2006.01)
*C22C 1/03* (2006.01)

(52) U.S. Cl. ..... 148/538; 75/603; 75/604

(58) Field of Classification Search ..... 148/538; 75/603, 604
See application file for complete search history.

(56) References Cited

U.S. PATENT DOCUMENTS 5,248,477 A 9/1993 Green et al.

FOREIGN PATENT DOCUMENTS

| | | | |
|---|---|---|---|
| EP | 1 460 141 | A1 | 9/2004 |
| GB | 533 266 | A | 2/1941 |
| RU | 1 727 403 | C | 11/1943 |
| WO | WO 99/49089 | A | 9/1999 |
| WO | WO 01/02614 | A1 | 1/2001 |

OTHER PUBLICATIONS

Examiner did not cited any reference.*
Inventor's Certificate No. 442225; Invention Bulletin 33, 1974, p. 1.
Collected works of Baikov Institute for Metallurgy edited by Nauka Publishing House, 1978, pp. 140-144.
German Standard EN 1753-1997.
B.I. Bondarev, "Melting and Casting of Wrought Magnesium Alloys" edited by Metallurgy Publishing House, Moscow, Russia 1973, pp. 119-122.
I.P. Vyatkin, V.A. Kechin, S.V. Mushkov, "Primary magnesium refining and melting" edited by Metallurgy Publishing House, Moscow,Russia 1974, pp. 54-56, pp. 82-93.

* cited by examiner

*Primary Examiner*—Sikyin Ip
(74) *Attorney, Agent, or Firm*—Brooks Kushman P.C.

(57) ABSTRACT

The invention relates to magnesium-based alloys and, more specifically, to a magnesium alloy composition and methods of producing the same. The alloys have improved mechanical properties in that creep ratios are decreased. The magnesium-based alloys comprise aluminium, zinc, manganese and silicon. A method for producing said alloy consists of loading the alloying components, pouring the molten magnesium, introducing a titanium-containing fusion cake with a flux agent and continuously agitating. The alloy is then soaked and cast.

13 Claims, No Drawings

MAGNESIUM-BASED ALLOY AND METHOD FOR THE PRODUCTION THEREOF

BACKGROUND OF THE INVENTION

1. Field of the Invention

This invention relates generally to magnesium-based alloys and more specifically to magnesium alloy compositions and methods of producing them that are for use in the automotive industry.

2. Background Art

There are various alloys developed for special applications including, for example, die casting of automotive components. Among these alloys magnesium-aluminium alloys can be designated as cost-effective and widely used for manufacture of automotive parts, e.g. AM50A alloy (where AM means aluminium and manganese are in the composition of the alloy) containing approx. 5 to 6 wt. % aluminium and manganese traces, and magnesium-aluminium-zinc alloys, e.g. AZ91D (where AZ means aluminium and zinc are in the composition of the alloy) containing approx. 9 wt. % aluminium and 1 wt. % zinc.

The disadvantage of these alloys is their low strength and poor creep resistance at elevated operating temperatures. As a result, the above mentioned magnesium alloys are less suitable for motor engines where some components such as transmission cases are exposed to temperatures up to 150° C. Poor creep resistance of these components can lead to a decrease in fastener clamp load in bolted joints and, hence, to oil leakage.

Known in the present state of art is a magnesium-based alloy (Inventors' certificate No. 442225 issued in Invention Bulletin 33, 1974) containing aluminium, zinc, manganese, and silicon as alloying components in the following amounts:

Aluminium—6–15 wt. %
Zinc—0.3–3.0 wt. %
Manganese—0.1–0.5 wt. %
Silicon—0.6–2.5 wt. %
Magnesium—balance.

The disadvantages of this alloy are its low ductility, high hot shortness, and insufficient strength of the alloy which keeps this alloy from automotive applications.

Known presently is another magnesium die cast alloy ("Magnesium alloys" in Collected works of Baikov Institute for Metallurgy edited by Nauka Publishing House, 1978, p.140–144) which comprises aluminium, zinc, manganese, and silicon as alloying components in the following amounts:

Aluminium—3.5–5.0 wt. %
Zinc—under 0.12 wt. %
Manganese—0.20–0.50 wt. %
Silicon—0.5–1.5 wt. %
Copper—under 0.06
Nickel—0.03 wt. %

The drawback of this alloy is that the quantitative composition of the alloy selected provides poor mechanical properties, in particular, the alloy having a small solidification range is characterised with advanced susceptibility to cracking in case of hindered contraction and bad castability.

A well-known German standard EN 1753-1997 is taken as the closest prior art by its qualitative and quantitative composition and discloses the methods of manufacture of EN MB MgAl2Si and EN MB MgAl4Si alloys. The qualitative analysis of the alloys is the following, in wt. %:

EN MB MgAl2Si:
Al—1.9–2.5
Mn—min 0.2
Zn—0.15–0.25
Si—0.7–1.2

EN MB MgAl4Si (AS41):
Al—3.7–4.8
Mn—0.35–0.6
Zn—max 0.10
Si—0.6–1.4

The alloys of the above quantitative and qualitative compositions demonstrate better mechanical properties. However, at 150–250° C. these alloys have high creep that keeps these alloys from machine-building applications. Presently known is the method (PCT Patent No. 94/09168) for making a magnesium-based alloy that provides for alloying components in a molten state being introduced into molten magnesium. Primary magnesium and alloying components are therefor heated and melted in separate crucibles.

A disadvantage of this method is the need to pre-melt manganese and other alloying elements (at the melting temperature of 1250° C.) that complicates alloy production and process instrumentation.

There are some other methods known (B. I. Bondarev "Melting and Casting of Wrought Magnesium Alloys" edited by Metallurgy Publishing House, Moscow, Russia 1973, pp 119–122) to introduce alloying components using a master alloy, e.g. a magnesium-manganese master alloy (at the alloying temperature of 740–760° C.).

This method is disadvantageous because the alloying temperature should be kept high. This leads to extremely high electric power consumption for metal heating and significant melting loss.

Also known is another method of producing a magnesium-aluminium-zinc-manganese alloy (I. P. Vyatkin, V. A. Kechin, S. V. Mushkov in "Primary magnesium refining and melting" edited by Metallurgy Publishing House, Moscow, Russia 1974, pp. 54–56, pp. 82–93) which is taken as an analogue-prototype. This method stipulates various ways for feeding molten magnesium and alloying components such as aluminium, zinc, and manganese. One of these approaches includes simultaneous charging of solid aluminium and zinc into a crucible, then heating above 100° C., pouring in molten primary magnesium and again heating up to 700–710° C. and introducing titanium-containing fusion cake together and manganese metal under continuous agitation.

The main shortcoming of the method is in considerable loss of alloying components, resulting in lower recovery of alloying components in magnesium and preventing from producing alloys with specified mechanical properties. Furthermore, this increases the cost of the alloy.

SUMMARY OF THE INVENTION

Accordingly, it is an object of the present invention to improve mechanical properties of the alloy and, in particular, to decrease its creep and loss of alloying constituents in manufacturing the alloy.

The invention makes it possible to reduce the production costs of the alloy and to improve the performance characteristics thereof in order to extend the use of said alloy for the automobile industry.

These objects are accomplished due to the fact that the claimed magnesium-based alloy comprises aluminium, zinc, manganese and silicon, wherein the constituents specified are in the following amounts, wt. %:

Aluminium—2.5–3.4
Zinc—0.11–0.25
Manganese—0.24–0.34
Silicon—0.8–1.1
Magnesium—balance.

To manufacture the alloy there is a method which consists of loading of alloying components, pouring of molten magnesium, introducing a titanium-containing fusion cake together with a flux agent and continuously agitating. The alloy is soaked and cast. The alloying components of aluminium, zinc, manganese, and silicon are added in the form of a ready-made solid master alloy of aluminium-zinc-manganese-silicon. After being poured in, the magnesium is heated, subjected to ageing and then stirred.

Further, the proportion of the master alloy to magnesium is 1:(18–20).

Further, magnesium is heated up to 720–740° C.

Further, the ageing process lasts for 1–1.5 hrs.

The quantitative composition of the magnesium-based alloy produces better mechanical properties of the alloy.

Aluminium added into magnesium contributes to its tensile strength at ambient temperature and alloy castability. However, it is well-known that aluminium is detrimental to creep resistance and strength of magnesium alloys at elevated temperatures. This results from the case that aluminium, when in higher quantities, tends to combine with magnesium to form great amounts of intermetallic $Mg_{17}Al_{12}$ having a low melting temperature (437° C.) which impairs high-temperature properties of aluminium-based alloys. The aluminium content of 2.5–3.4 wt. % that was chosen for the proposed magnesium-based alloy provides better properties of magnesium-based alloys, such as creep resistance.

The properties of the alloy, especially its castability, are further influenced by zinc content; however, added in large amounts, zinc can lead to cracking. Therefore, proposed zinc content is within 0.11–0.25 wt. % to be optimum for the magnesium-based alloy.

In order to enhance service performance and functionality and expand the scope of application at higher temperatures (up to 150–200° C.) silicon is added into the alloy as an active alloying additive to form a metallurgically stable phase of $Mg_2Si$ that is precipitated slightly at grain boundaries and, hence, to increase creep resistance of the alloy at high temperatures. Silicon content of 0.8–1.1 wt. % claimed in accordance with the present invention promotes a decreasing creep level of the magnesium-based alloy.

The alloy is loaded with manganese in the amount of 0.24–0.34 wt. % in order to ensure corrosion resistance.

The alloying components are introduced in the form of the pre-prepared aluminium-zinc-manganese-silicon master alloy, which is added in a certain proportion to magnesium, i.e. 1:(18–20), and this, therefore, enhances recovery of the additives in magnesium, thus lowering the losses of expensive chemicals.

It is another difficulty in making alloys with a silicon content that silicon and manganese as alloying components react to form heavy intermetallic phases $Mn_3Si$ and $MnSi_2$, which deposit at the bottom of crucibles at the end of production process, and this hinders high level of recovery of these components. Thus, a better recovery of the alloying additives can be produced using the pre-prepared aluminium-based master alloy.

With process temperature maintained at 720–740° C. the level of recovery of alloying elements in the magnesium-based alloy can be 98.8–100% in case of aluminium, 68.2–71.1% in case of manganese, 89.3–97.4 in case of silicon, 85.9–94.4% in case of zinc.

DETAILED DESCRIPTION OF PREFERRED EMBODIMENTS

Preparation of Al—Mn—Si—Zn Master Alloy

Composition: aluminium—matrix, manganese—6.0–9.0 wt. %, silicon—24.0–28.0 wt. %, zinc—2.0–3.0 wt. %, inclusions, in wt. %: iron—0.4, nickel—0.005, copper—0.1, titanium—0.1. The master alloy is produced in ingots.

The master alloy is manufactured in an 'AIAX'-type induction furnace. A97 grade aluminium (acc. to GOST 11069) is charged in the furnace and heated up to 910–950° C.; the master alloy is melted under cryolite flux in the amount of 1–1.5% of the pre-weighted quantity required for the process. Kpl (Kr1) grade crystalline silicon is fed in portions in the form of crushed pieces, or wrapped in aluminium foil or wetted with zinc chloride solution to prevent them from oxidation. Silicon is dissolved in small portions and thoroughly stirred. The composition obtained is thereafter added with manganese metal of MH95 grade (Mn95 acc. to GOST 6008) in the form of 100 mm pieces, stirred again and heated up to the temperature within 800–850° C.; finally added with Ц-grade zinc (Z1 acc. to GOST 3640). 16 kg ingots are cast in moulds.

EXAMPLE 1

The solid master alloy of Al—Mn—Si—Zn in the form of ingots in the proportion of master alloy to magnesium 1:(18–20) are charged into a preheated crucible of furnace SMT-2. In the same crucible raw magnesium M90 (MG-90 acc. to GOST 804-93) is poured in the amount of 1.8 tons from a vacuum ladle and is afterwards heated. On reaching 730–740° C. of the metal temperature a heated agitator is placed in the crucible. The alloy is left undisturbed in the crucible for 1–1.5 hrs prior to mixing and then mixed for max. 40–50 min; a titanium-containing fusion cake (TU 39-008) being in the compound with barium flux in the proportion of 1:1 is added, and mixed again; the temperature of the alloy is then reduced to 710–720° C. The alloy produced was left in the crucible for 60 min and thereafter the alloy was sampled for chemical analysis to define Al, Mn, Zn, Si content and impurities. The alloy composition was in wt. %: Al—2.5–3.4, Mn—min 0.23, Si—0.8–1.3, Be—0.0008–0.0012, Zn—min 0.18, Fe—min 0.003.

Industrial Applicability

TABLE 1

Mechanical properties of the magnesium-based alloy at 150° C.

| Type of alloy | Creep test σ, MPa | Creep ratio σ, % | Mechanical properties at 150° C., $\sigma_B$ MPa |
|---|---|---|---|
| AZ91 | 45.0 | 0.82 | 136 |
| EN MB $MgAl_2Si$ (AS 21) | 45.0 | 0.490 | 128 |
| EN MB $MgAl_4Si$ | 45.0 | 0.540 | 139 |
| AS 31 alloy claimed | 45.0 | 0.143 | 128 |

TABLE 2

| | Level of recovery of alloying elements in the magnesium-based alloy |
|---|---|
| Constituents | Recovery level, % |
| Aluminium | 100 |
| Manganese | 73.5–96.3; at 720–740° C. and time of agitation 40–50 min recovery level of manganese is 80–96% |
| Silicon | 80.8–92.5 |
| Zinc | 84.8 |

FIGS. 1 and 2 illustrate the level of recovery of alloying elements in the magnesium-based alloy depending on the temperature and time of agitation.

Thus, the magnesium-based alloy of said qualitative composition and the method to prepare it improve the mechanical properties of the alloy, particularly, to decrease creep ratio by 3–4 times and reduce production costs due to a better recovery of alloying components in magnesium.

The invention claimed is:

1. A method for producing a magnesium-based alloy comprising the steps of:

a. loading alloying components into a crucible in the form of a master alloy including
   i. Aluminium—remainder
   ii. Zn—2.0–3.0 wt. %
   iii. Si—24.0–28.0 wt. %
   iv. Mn—6.0–9.0 wt. % b. pouring molten Mg into the crucible to form an alloy
   i. heating
   ii. aging; and
   iii. stirring said alloy c. introducing a Ti-containing fusion cake with a fluxing agent to said alloy
   i. continuously agitating the cake in said alloy to form a magnesium based alloy d. cooling the magnesium-based alloy e. soaking; and f. casting said magnesium-based alloy.

2. The method of claim 1 wherein the master alloy is a solid master alloy.

3. The method of claim 1, wherein the proportion of the master alloy content to magnesium is 1:(18–20).

4. The method of claim 1, wherein magnesium is heated up to 720–740° C.

5. The method of claim 1, wherein the ageing is carried out for 1–1.5 hrs.

6. The method of claim 1 wherein the loading step comprises loading components in the form of a ready-made solid master alloy.

7. The method of claim 1 wherein the step of loading alloying components further comprises providing Al in the amount of 2.5–3.4 wt. % in cast magnesium alloy.

8. The method of claim 1 wherein the step of loading alloying components comprises providing Si in the amount of 0.8–1.1 wt. % in cast magnesium alloy, the Si forming a metallurgically stable phase of $Mg_2Si$ that is precipitated at grain boundaries, thereby improving the mechanical properties of the alloy.

9. The method of claim 1 wherein the step of loading alloying components further comprises providing Zn in the amount of 0.11–0.25 wt. % in cast magnesium alloy for fluidity.

10. The method of claim 1 wherein the step of loading alloying components further comprises the step of providing Mn in the amount of 0.24–0.34 wt. % in cast magnesium alloy for corrosion resistance.

11. The method of claim 1 wherein the step of loading alloying components in the form of a master alloy comprises adding a ready-made solid master alloy in a proportion to Mg of 1:(18–20) for the recovery of additives and reducing the loss of chemicals.

12. The method of claim 1 wherein steps 0(a–c) are conducted at 720–740° C., thereby enabling a level of alloy recovery of Al (98.8–100%); Mn (68.2–71.1%); Si (89.3–97.4%); and Zn (85.9–94.4%).

13. The method of claim 1 wherein the master alloy comprises the following components, wt. %:

Mn—6.0–9.0

Si—24.0–28.0

Zn—2.0–3.0 an inclusion selected from the group consisting of Fe 0.4; Ni 0.005; Cu 0.1; Ti 0.1 and combinations thereof; and Al—remainder.

* * * * *

UNITED STATES PATENT AND TRADEMARK OFFICE

CERTIFICATE OF CORRECTION

PATENT NO. : 7,135,079 B2
APPLICATION NO. : 10/496024
DATED : November 14, 2006
INVENTOR(S) : Tetyukhin Vladislav Valentinovich et al.

It is certified that error appears in the above-identified patent and that said Letters Patent is hereby corrected as shown below:

Column 6, Line 31, Claim 12:

After “steps” delete “0(a-c)” and insert therefor -- (a-c) --.

Signed and Sealed this

Twentieth Day of March, 2007

JON W. DUDAS
*Director of the United States Patent and Trademark Office*